United States Patent [19]

Reynolds et al.

[11] 4,158,580

[45] Jun. 19, 1979

[54] METHOD OF MAKING PRESSED MAGNETIC CORE COMPONENTS

[75] Inventors: William T. Reynolds, Peters Township Allegheny County; Norman M. Pavlik, Wilkins Township, Allegheny County, both of Pa.

[73] Assignee: Westinghouse Electric Corp., Pittsburgh, Pa.

[21] Appl. No.: 896,535

[22] Filed: Apr. 14, 1978

[51] Int. Cl.[2] ..... H01F 1/08

[52] U.S. Cl. ..... 148/104; 148/105; 148/122; 264/111; 264/DIG. 58; 427/127

[58] Field of Search ..... 148/104, 105, 121, 122; 29/128, 546; 428/928, 622, 630; 264/111, DIG. 58; 427/127, 130

[56] References Cited

U.S. PATENT DOCUMENTS

| | | | |
|---|---|---|---|
| 2,977,263 | 3/1961 | Harendza-Harinxma | 148/104 |
| 3,014,825 | 12/1961 | Harendza-Harinxma | 148/104 |
| 3,498,918 | 3/1970 | Copp | 148/104 |
| 3,848,331 | 11/1974 | Pavlik et al. | 148/105 |
| 3,948,690 | 4/1976 | Pavlik et al. | 148/105 |

*Primary Examiner*—Arthur J. Steiner
*Attorney, Agent, or Firm*—L. P. Johns

[57] ABSTRACT

A method of making pressed magnetic core components characterized by coating particles of annealed low carbon ferrous alloy with a coating of hydrated magnesium silicate.

4 Claims, No Drawings

METHOD OF MAKING PRESSED MAGNETIC CORE COMPONENTS

CROSS-REFERENCE TO RELATED APPLICATIONS

This invention is related to the copending applications of R. F. Krause, N. Pavlik, and K. A. Grunert, Ser. No. 896,525, filed Apr. 14, 1978; R. F. Krause, Ser. No. 896,526, filed Apr. 14, 1978; N. Pavlik and J. Sefko, Ser. No. 896,533, filed Apr. 14, 1978; R. F. Krause and N. Pavlik, Ser. No. 896,534, filed Apr. 14, 1978; and R. F. Krause, N. Pavlik, and C. Eaves, Ser. No. 896,536, filed Apr. 14, 1978.

BACKGROUND OF THE INVENTION

1. Field of the Invention

This invention relates to a method for making magnetic cores for use in electrical apparatus, and more particularly, it pertains to microlaminations having coatings of hydrated magnesium silicate.

2. Description of the Prior Art

All particulate cores require insulation of particles if eddy current losses are to be low. Fine powder cores are impractical to insulate unless insulation also bonds cores together.

Iron, low carbon steel, or silicon steel particles which are made into magnetic cores by powder metallurgy techniques require an electrically insulative coating on them to minimize eddy current losses in alternating current applications. Such particles, other than those of the socalled "microlaminations," are obtained either by slitting and chopping thin gauge strip, reclaiming the scrap from chip removal operations, such as sawing or machining, or by various other comminutive processes. Generally, the particles are cleaned if necessary, decarburized, annealed, coated with an insulative material, typically magnesium methylate ($Mg(OCH_3)_2$) in eight weight percent solution in methanol, and then pressed into final shape such as a magnetic core.

The insulative coating has several severe requirements. First, it must be extremely thin so that the compacted particles will have a very high packing factor, i.e. a high ratio (>0.9) of core density to theoretical density. The higher the packing factor can be made, the greater will be the magnetic permeability. Second, the coating must cover the particle surfaces thoroughly, particularly at edges, corners and asperities so that each particle is insulated from its neighboring particles in the pressed core. The better the microlaminations are covered, the lower will be the core loss. Third, the coating must withstand elevated temperature since in many applications it is desirable to anneal the compacted core in order to lower the coercive force and ore loss and raise permeability. Fourth, the coating must withstand extensive deformation and abrasion during the pressing operation yet still provide adequate interparticle insulation after pressing. Fifth, the coating must be cheap, readily available and easily applied to the microlaminations.

SUMMARY OF THE INVENTION

It has been found in accordance with this invention that the foregoing requirements are satisfied by a method of making pressed magnetic core components comprising the steps of forming microlaminations from thin, flat strips of ferrous alloys, annealing the microlaminations in decarburizing atmosphere to improve the magnetic characteristics by reducing carbon content to less than 0.01%, coating the microlaminations with a layer of hydrated magnesium silicate, compressing the microlaminations into a solidified configuration, and annealing the solidified compact in a temperature range of from about 1000° F. to about 1650° F. (537°-900° C.) to obtain high permeability and low coercive force values.

The cores produced when practicing the method of this invention provide for improved performance over cores using presently known coatings for particulate cores as magnesium methylate, dry boron nitride powder, mixtures of boron nitride in water, water mixtures of boron nitride with additions of potassium silicate, and mixtures of magnesium methylate with magnesium hydroxide. Talc (hydrated magnesium silicate, 3 $MgO.4SiO_2.H_2O$) is the material which best fulfills the criteria recited abov.

DESCRIPTION OF THE PREFERRED EMBODIMENT

According to the present invention, the new method is carried out in the following manner:

(a) forming microlaminations from thin, flat strips of ferrous alloys, (b) annealing the microlaminations in decarburizing atmosphere to improve the magnetic characteristics by reducing the carbon content to less than 0.01%, (c) coating the microlaminations with a layer of hydrated magnesium silicate, (d) compressing the microlaminations into a solidified configuration, and (e) annealing the solidified compact at a temperature range of from about 537° C. to about 900° C. to obtain high permeability and low coercive force values.

The term "microlaminations," defined as a small particle of steel that, when processed in a specific manner, results in a formed compact possessing soft magnetic characteristics which is generally disclosed in U.S. Pat. Nos. 3,848,331 and 3,948,690.

The material from which the microlaminations are made is preferably a plain carbon steel normally of that type used for tin cans, e.g., AISI 1010. This is a low carbon steel and is recommended because of its low cost and availability. The material is usually purchased in the form of "black plate," that is, the condition of the tin can steel prior to tinning. It is readily available in a wide range of thicknesses usually ranging from about 0.005 to about 0.020 inch in thickness. This black plate tin can stock material is one of the lowest cost ferrous products in this thickness range. Typically the AISI Type 1010 steel has a composition containing between about 0.07% and about 0.13% carbon, about 0.30% and about 0.60% manganese, about 0.040% maximum phosphorus, about 0.050% maximum sulfur, and the balance essentially iron with incidental impurities. The preferred material is a plain carbon steel, but other magnetic materials as silicon containing steels as well as nickel-iron, molybdenum permalloy, and other soft magnetic alloys may be employed in practicing the present invention.

It is preferred to have the steel with some degree of strength to it so that when the microlaminations are formed they do not become grossly distorted as will appear more fully hereinafter. Consequently, a plain carbon steel from about 0.05 to 0.15% carbon is ideally suited, for this material will have sufficient strength and yet is sufficiently ductile that the steel can be readily sheared into microlamination sizes as will be described. While exceedingly low carbon steels ("iron") are employed, they are not recommended because of the tendency to distort and form burred edges during the microlamination formation operation. The plain carbon steel or other soft magnetic alloy is usually purchased in the cold rolled condition, the plain carbon steel preferably has a grain size of the order of ASTM No. 9. By employing the various magnetic materials in their cold worked condition, from which the microlamination is formed having the form of a thin, elongated parallelopiped of substantially rectangular cross-section. The cold worked condition of the flat worked sheet material thus facilitates the formation and the retention of the assevered shape. Moreover, the cold worked condition with its consequent higher strength and lowered ductility fosters a cleaner edge, (less burring) during the forming operation so that when the microlaminations are molded into the finished configuration, the tendency to pierce the insulation is considerably reduced.

At the outset, it should be noted that while a wide range of steel particle sizes and thicknesses are satisfactory, it is nonetheless preferred to control the microlaminations to the form of a thin elongated parallelopiped of rectangular cross-section having dimensions between about 0.05 and about 0.20 inch in length, about 0.005 and about 0.05 inch in width and from about 0.002 to about 0.02 inch in thickness. Within this broad range, particularly satisfactory results have been obtained where the individual microlamination particle length ranges from about 0.050 to about 0.150 inch, from about 0.010 to about 0.030 inch in width and between about 0.006 and about 0.013 inch in thickness. The microlaminations are usually formed from tin can stock to the foregoing dimensions by cutting with a high speed rotary die cutter as set forth in U.S. Pat. No. 3,848,331, or as set forth in U.S. Pat. No. 3,948,690.

The second step of the invention involves annealing of the microlaminations in order to decarburize the microlaminations to a carbon content of less than 0.010%. Decarburization is desirable to obtain better magnetic properties because carbon causes higher core loss and affects permeability. Lower carbon is desirable to eliminate magnetic aging, thus improving the overall magnetic characteristics. A working temperature range for annealing is from about 1000° F. to about 1650° F. (537°-900° C.) for 30 minutes in moist hydrogen usually having a dew point of about +120° F. The preferred temperature for annealing is about 1472° F. Optimum decarburizing atmosphere is provided by the use of moist hydrogen having a high dew point of about 28° C. The combination of moisture and hydrogen removes carbon from the microlamination particles and maintains a deoxidizing atmosphere in the furnace. The resulting microlaminations have a bright surface.

The third step, in accordance with this invention, involves the coating of the annealed microlaminations with a layer of hydrated magnesium silicate (talc). A suitable method for coating the microlaminations is by simply tumbling the microlaminations with 0.5% of their weight of the talc.

Talc is superior to other coating materials for a number of reasons. First, it is more readily available, cheaper and easier to apply to microlaminations than other materials such as magnesium methylate and may be applied in a cone blender or a barrel tumbler. Second, the use of talc avoids handling any flammable solvent such as the methanol contained in magnesium methylate. Third, talc provides lubrication between the microlaminations which aids in subsequent compaction. No pressing lubricant such as zinc stearate is required to be mixed with talc-coated microlaminations because talc itself serves as a pressing lubricant. Moreover, talc-coated microlamination cores have better magnetic properties than magnesium methylate cores after stress-relief annealing since talc withstands elevated temperatures without degradation of electrical insulative properties. In the "as pressed" condition magnetic properties of cores are equivalent to those cores of magnesium methylate coated microlaminations.

The fourth step involves compressing of the microlaminations into a solidified configuration such as a magnetic core, by powder metallurgy techniques. Such compacted magnetic cores require an electrically insulative coating on the microlaminations to minimize eddy current losses in alternating current applications.

The fifth step of annealing the solidified compact may be omitted because the performance of talc-coated microlaminations is comparable to the magnesium methylate as a coating for microlaminations in the "as pressed" condition. However, the performance of talc-coated microlaminations in the annealed condition is superior to that of microlaminations coated with magnesium methylate. Where higher permeabilities with low losses are necessary, the step of annealing is performed. Accordingly, annealing the solidified compact is performed in the temperature range of from about 1000° F. to about 1650° F. 9573° C.-900° C.). The preferred annealing temperature is 1562° F. (850° C.) for one hour. Although satisfactory permeability and core losses are achieved without annealing, annealing does improve these properties.

The following is an example illustrative of this invention:

EXAMPLE

Three types of microlaminations were used to compare coating performance of talc with magnesium methylate. The first type was made with an experimental machine designed to slit and chop rectangular particles from commercial "tin-can" steel in the blackplate (untinned), unannealed state. The size of this type of microlamination which was available for the work described in this report is 0.006 in. (0.15 mm.)×0.020 in. (0.51 mm.)×0.080 in. (2.0 mm.). After the slitting/chopping operation the particles were given a decarburization anneal in a continuous belt furnace for approximately thirty minutes in moist hydrogen (dew point 28° C.) at 800° C. Carbon content of the blackplate was 0.085 weight percent, and of 0.0011 weight percent for the annealed microlaminations. The second type of microlamination particle used for coating study was made by machining a stack of 0.013 in. (0.33 mm.) blackplate sheets in a milling machine. This operation provided spiralled chips which were about 0.04 in. (1 mm.) long×0.004 in. (0.1 mm.) thick with triangular or diamond-shaped cross-section having thin edges and one rough surface. These chips were annealed as above and contained 0.0042 weight percent carbon. The third type of particle was made similar to the second type by milling a stack of 0.060 in. (1.5 mm.) hot rolled AISI 1020 carbon steel sheets into curled chips about 0.04 in. (1 mm.) long×0.008 in (0.2 mm.) thick with rectangular cross-section, thin edges and one rough surface. These chips were also annealed for decarburization as above and contained 0.0053 carbon.

Annealed microlaminations of each type were then coated with magnesium methylate by immersing them briefly in an 8 weight percent solution of $Mg(OCH_3)_2$ in methanol and then drying them by evaporation of the methanol in air. Other microlaminations of each type were coated with Carolina talc (Whitaker, Clark and Daniels Inc. product #367000) by tumbling them with 0.5% of their weight of the talc in a glass jar on a ball mill.

After coating, the various lots of particles were weighed and cold pressed at either 40, 80, or 120 kpsi into 1.0 in. (25.4 mm.) ID×1.75 in. (4.45 mm.) OD rings for magnetic testing, and 1.0 in. (25.4 mm.) diameter×0.5 in. (12.7 mm.) cylinders for compression testing. No pressing lubricant was blended with the particles; only zinc stearate mold release was sprayed on the die walls prior to pressing each ring or cylinder.

After compacting, the packing factor of each cylinder and test ring was calculated from their dimensions and weights. Packing factor is the density of the compact as pressed divided by the density of iron times 100%. DC properties for an applied field of 50 Oe were measured according to ASTM standard A596 and AC properties according to A343. Compressive yield strength of the cylinders was determined according to ASTM standard D695 to provide an indication of particle cohesion in pressed compacts.

Rings representing each type of microlamination, each coating material and each pressing pressure were annealed by heating to 850° C., holding for one hour and furnace cooling in a dry hydrogen atmosphere after which they were magnetically tested as above.

Packing factors are tabulated in Tables I–III for magnetic test rings accompanied by corresponding packing factor and compressive yield strength values of test cylinders for three types of microlaminations each compacted at one of three pressures. Microlaminations of the slit/chopped type were compacted bare (cylinder) as well as coated with magnesium methylate or talc for strength comparison. Particles of the other two types were compacted only with magnesium methylate or talc coatings. Packing factors for the bare microlaminations were lower at a given pressure than those for the coated microlaminations; compressive strength was similar to that for the coated microlamination cylinders, particularly at the intermediate and high compacting pressures (Table I). The presence of either magnesium methylate or talc on microlaminations does not adversely affect compressive strength when at least 80,000 psi compacting pressure is used. As in prior experience in microlamination studies, packing factor and strength of microlamination compacts increase as compacting pressure is increased for all three types of particles. Packing factors for the pressed cylinders are higher than those of the corresponding rings because the cylinder is more favorable for compaction than the ring since it has lower surface-to-volume ratio (less die and punch friction). Compressive yield strengths of talc coated compacts tend to be slightly lower than those of methylate coated compacts, particularly at compacting pressures of 80,000 psi and 120,000 psi.

Magnetic properties of magnesium methylate-coated and talc-coated microlamination test rings, as pressed, are tabulated side-by-side in Tables IV–VI for three pressing pressures and the three types of microlamination particles. Magnetic properties of test rings in the annealed condition are similarly listed in Tables VII–IX. These results are analyzed in regard to coating material requirements in the following discussion.

The requirements of a coating material for microlaminations as mentioned in the introduction are briefly that (1) the material must provide a very thin coating, (2) it must cover the particles thoroughly, (3) it must be stable at annealing temperatures, (4) it must withstand deformation, and (5) is must be cheap and easy to use.

In regard to the first requirement it was shown by determination of packing factor, which is a commonly used indicator of coating thickness on magnetic core laminations, that talc can be thinly applied to microlaminations. Compression test cylinders and magnetic test rings compacted from talc-coated microlaminations have packing factors which equal those of similar compacts made with magnesium methylate coated microlaminations (Table I). Compressive yield stress of the talc-coated microlamination compacts is comparable to that of the magnesium methylate-coated microlamination compacts for a given compacting pressure. Moreover, packing factors of talc-coated iron particle (machined chips) compacts equal or exceed the packing factors of compacts made with the same particles coated with magnesium methylate (Tables II and III). Compressive yield strength is somewhat lower in the talc-coated particle compacts. It is concluded from these data that talc provides as thin a coating as magnesium methylate and therefore meets the first requirement (thinness) mentioned above.

Particle coverage, the second requirement, of a good coating material, can be inferred by comparing core loss, $P_c$, or exciting power, $P_z$, of magnetic test rings made using the same type of particle and the same compacting pressure but different coatings. $P_z$ generally parallels AC permeability, $\mu$, which is a function of the density (packing factor) of the test ring. Tables IV through VI compare $P_c$, $P_z$ and AC$\mu$ values between magnesium methylate-coated and talc-coated iron particles compacted into test rings. The test rings made of talc-coated microlaminations exhibit $P_c$ values very similar to those for magnesium methylate-coated microlaminations; AC permeability values are slightly lower, and $P_z$ values are slightly higher than those for magnesium methylate-coated microlaminations (Table IV). Similar behavior is shown in the $P_c$, AC permeability and $P_z$ obtained with particles either machined from blackplate or from hot rolled 1020 steel (Tables V and VI).

Summarizing the comparisons of $P_c$, AC$\mu$ and $P_z$ in test rings made of the machine iron particles, it is shown that talc is comparable to magnesium methylate in its particle coverage and insulative qualities since respective AC properties are comparable (Tables V and VI). In the test rings made f slit/chopped particles, the insulative quality of talc is comparable to that of magnesium methylate since respective $P_c$ values are nearly equal, but the permeability is somewhat lower.

The third requirement of a coating material is that it must withstand elevated temperature to permit annealing of compacted cores without degradation of interparticle insulation. Although many cores do not require annealing, some do. Therefore, it is desirable to have one material which fulfills both needs to minimize buying, inventory and process equipment costs. High temperature stability of the coating is measured by the change in loss, $\Delta P_c$, observed before and after annealing. If $P_c$ is higher after annealing of the core it indicates that interparticle insulation has broken down thereby permitting increased eddy currents. Tables VII through IX list comparative $P_c$ data for magnetic test rings made from the various iron particles coated with magnesium methylate or talc. Table VII shows that annealing the talc-coated microlamination rings caused a decrease or a small increase in $P_c$, whereas annealing the magnesium methylate-coated microlamination test rings causes a very large increase in $P_c$. That is, the magnesium methylate coating failed to insulate the microlaminations to a far greater extent than the talc coating. In effect, a large amount of "sintering" of the particles was permitted by the magnesium methylate. Test rings made of particles machined from blackplate behave (Table VIII) in the same way as the microlaminations, although the core losses were much higher than the comparable values in Table VII and the relative differences between $P_c$ for the two types of coating materials are much less. This effect is attributed to the sharper edges and rougher surfaces of the machined particles as compared to the microlaminations. Sharp edges or surface asperities promote interparticle contacts through either coating which in turn promote sintering with resultant high $P_c$. Talc, however, still provides consistently lower core loss as well as somewhat higher permeability (lower exciting power) than magnesium methylate for these particles. Talc withstands annealing of iron particle cores better than magnesium methylate.

The fourth requirement mentioned above is that the coating material must withstand extensive deformation and abrasion during the pressing operation yet still provide interparticle insulation in the pressed core. Talc appears to meet this requirement somewhat better than magnesium methylate. Talc is a soft, slippery material with a layered structure which easily slips under shear stresses. In powder form it readily adheres to the iron particles and acts as a lubricant during pressing. Apparently talc "smears" over the particle surfaces as they are plastically deformed or abraded by each other during compaction. Some of the talc remains between the particles after compaction to provide electrical insulation. Magnesium methylate is present on the iron particles as a very thin continuous film which likely ruptures under the severe interparticle shear, bending and plastic flow of compaction thus exposing new surfaces to interparticle contact without insulation. This comparison of coating behavior is inferred from the physical characteristics of the two coating materials and the fact that talc provided better insulation than magnesium methylate after annealing of the compacted cores.

The fifth requirement that a coating material must be cheap, available and easily applied to the microlaminations or other iron particles is readily fulfilled by talc.

In conclusion, talc is relatively inexpensive and easy to apply to microlaminations as compared to magnesium methylate. Moreover, it has the advantage of being chemically stable, non-volatile, non-flammable, and non-toxic. The packing factor at a given pressure depends on configuration of the compact. Simple shapes which result in low die and punch friction yield high packing factors with either coating material.

TABLE I

| Coating: | | Comparison of Packing Factors* and Compressive Yield Strength for Microlamination** Compacts | | | | | |
|---|---|---|---|---|---|---|---|
| | | No Coating | | Magnesium Methylate | | Talc | |
| Compacting Pressure (psi) | | Packing Factor (%) | Compressive Yield Strength (psi) | Packing Factor (%) | Compressive Yield Strength (psi) | Packing Factor (%) | Compressive Yield Strength (psi) |
| 40,000 | Cylinder | 89 | 28,000 | 89 | 20,000 | 89 | — |
| | | 89 | 27,700 | 90 | 18,800 | 89 | 16,700 |
| | Ring | | | 84 | | 87 | |
| | | | | 86 | | 84 | |
| | | | | 85 | | 86 | |
| | | | | 86 | | 85 | |
| | Mean | | | 85 | | 86 | |
| 80,000 | Cylinder | 94 | 29,500 | 96 | 36,200 | 95 | 31,700 |
| | | 94 | 28.500 | 96 | 33.400 | 95 | 32,200 |
| | Ring | | | 89 | | 93 | |
| | | | | 94 | | 92 | |
| | | | | 93 | | 93 | |
| | | | | 93 | | 93 | |
| | Mean | | | 92 | | 93 | |
| 120,000 | Cylinder | 97 | 37,100 | 99 | 38,300 | 98 | 35,900 |
| | | 97 | 35,900 | 99 | 38,000 | 97 | 36,200 |
| | Ring | | | 97 | | 95 | |
| | | | | 96 | | 96 | |
| | | | | 96 | | 96 | |
| | | | | 97 | | | |
| | Mean | | | 97 | | 96 | |

*Density of compact (as pressed) ÷ density of iron × 100%.
**0.006 in × 0.020 in × 0.080 in low carbon steel (blackplate); decarburized.

TABLE II

| Coating: | | Comparison of Packing Factor and Compressive Yield Strength For Iron Particle* Compacts | | | |
|---|---|---|---|---|---|
| | | Magnesium Methylate | | Talc | |
| Compacting Pressure (psi) | | Packing Factor (%) | Compressive Yield Strength (psi) | Packing Factor (%) | Compressive Yield Strength (psi) |
| 40,000 | (a) Cylinder | 85 | 25,600 | 85 | 24,900 |
| | | 84 | 26,300 | 85 | 25,700 |
| | (b) Ring | 83 | | 84 | |

TABLE II-continued

| Comparison of Packing Factor and Compressive Yield Strength For Iron Particle* Compacts | | | | | |
|---|---|---|---|---|---|
| Coating: | | Magnesium Methylate | | Talc | |
| Compacting Pressure (psi) | | Packing Factor (%) | Compressive Yield Strength (psi) | Packing Factor (%) | Compressive Yield Strength (psi) |
| | | 82 | | 85 | |
| | | 82 | | 84 | |
| | Mean | 82 | | 84 | |
| 80,000 | (a) Cylinder | 94 | 43,400 | 95 | 34,600 |
| | | 94 | 44,100 | 95 | 42,400 |
| | (b) Ring | 93 | | 94 | |
| | | 93 | | 93 | |
| | | 93 | | 94 | |
| | Mean | 93 | | 94 | |
| 120,000 | (a) Cylinder | 98 | 50,300 | 98 | 41,800 |
| | | 97 | 44,000 | 98 | 48,800 |
| | (b) Ring | 96 | | 97 | |
| | | 96 | | 96 | |
| | | 96 | | 97 | |
| | Mean | 96 | | 97 | |

*Chips milled from 0.013 in thick low carbon steel (blackplate); decarburized; particles were about 1 mm long and 0.1-0.2 mm thick with triangular or diamond-shaped cross-section; one rough surface.

TABLE III

| Comparison of Packing Factor and Compressive Yield Strength For Iron Particle* Compacts | | | | | |
|---|---|---|---|---|---|
| Coating: | | Magnesium Methylate | | Talc | |
| Compacting Pressure (psi) | | Packing Factor (%) | Compressive Yield Strength (psi) | Packing Factor (%) | Compressive Yield Strength (psi) |
| 40,000 | (a) Cylinder | 85 | 24,200 | 89 | 26,100 |
| | | 86 | 27,500 | 89 | 30,200 |
| | (b) Ring | 84 | | 85 | |
| 80,000 | (a) Cylinder | 95 | 43,900 | 95 | 34,400 |
| | | 95 | 44,200 | 96 | 39,200 |
| | (b) Ring | 92 | | 93 | |
| | | 92 | | 93 | |
| 120,000 | (a) Cylinder | 97 | 50,200 | 97 | 46,700 |
| | | 97 | 50,600 | 98 | 47,400 |
| | (b) Ring | 96 | | 96 | |
| | | 96 | | 96 | |

*Machined chips from 0.060 in hot rolled low carbon steel (AISI 1020); decarburized; particles were about 1 mm long and 0.1-0.2 mm thick with curled rectangular cross-section; uniform size; thin edges; one rough surface.

TABLE IV

| Comparison of Magnetic Properties of Microlamination* Test Rings As Compacted | | | | | | | | | | |
|---|---|---|---|---|---|---|---|---|---|---|
| Coating Properties: | Magnesium Methylate | | | | | Talc | | | | |
| Compacting | DC | AC | | | | DC | AC | | | |
| Pressure (psi) | | Induction CKG) | $P_c$ (W/lb) | $P_z$ (VA/lb) | $\mu$ | | Induction (KG) | $P_c$ (W/lb) | $z$ (VA/lb) | $\mu$ |
| 40,000 | $B_{50}$ = 10,400G | 2 | 0.45 | 0.95 | 430 | $B_{50}$= 10,200G | 2 | 0.29 | 0.94 | 396 |
| | | 4 | 1.04 | 3.30 | 473 | | 4 | 0.87 | 3.44 | 418 |
| | $B_{r50}$ = 2,600G | 6 | 1.88 | 7.65 | 417 | $B_{50}$ = 1,950G | 6 | 1.68 | 8.37 | 373 |
| | | 8 | 2.86 | 18.0 | 328 | | 8 | 2.64 | 17.8 | 300 |
| | $H_c$ = 2.93 Oe | 10 | 3.90 | 39.0 | 218 | $H_c$ = 2.70 Oe | 10 | 3.69 | 3.69 | 219 |
| | | 12 | 4.91 | 98.2 | 125 | | 12 | 4.78 | 66.0 | 140 |
| 80,000 | $B_{50}$ = 13,100G | 2 | 0.35 | 0.76 | 508 | $B_{50}$ = 12,000G | 2 | 0.26 | 0.75 | 462 |
| | | 4 | 0.84 | 2.19 | 646 | | 4 | 0.80 | 2.53 | 532 |
| | $B_{r50}$ = 3,700G | 6 | 1.64 | 4.60 | 635 | $B_{r50}$ = 2,375G | 6 | 1.52 | 5.77 | 508 |
| | | 8 | 2.57 | 8.90 | 565 | | 8 | 2.37 | 11.4 | 441 |
| | $H_c$ = 2.90 Oe | 10 | 3.44 | 17.3 | 454 | $H_c$ = 2.75 Oe | 10 | 3.39 | 21.5 | 355 |
| | | 12 | 4.52 | 33.5 | 328 | | 12 | 4.42 | 40.7 | 259 |
| | | 14 | 5.57 | 72.8 | 202 | | 14 | 5.52 | 82.9 | 168 |
| | | 15 | 6.25 | 116 | 144 | | | | | |
| 120,000 | $B_{50}$ = 14,600G | 2 | 0.30 | 0.66 | 550 | $B_{50}$ = 12,200G | 2 | 0.26 | 0.75 | 452 |
| | | 4 | 0.78 | 1.98 | 725 | | 4 | 0.78 | 2.59 | 507 |
| | $B_{r50}$ = 4,600G | 6 | 1.45 | 4.00 | 742 | $B_r^{50}$ = 2,500G | 6 | 1.49 | 6.00 | 481 |
| | | 8 | 2.25 | 7.4 | 620 | | 8 | 2.32 | 11.8 | 422 |
| | $H_c$ = 2.83 Oe | 10 | 3.14 | 13.7 | 556 | $H_c$ = 2.75 Oe | 10 | 3.28 | 21.9 | 344 |
| | | 12 | 4.15 | 24.4 | 436 | | 12 | 4.34 | 40.2 | 261 |
| | | 14 | 5.18 | 45.9 | 303 | | 14 | 5.42 | 77.4 | 177 |

TABLE IV-continued

Comparison of Magnetic Properties of Microlamination*
Test Rings As Compacted

| Coating Properties: Compacting Pressure (psi) | Magnesium Methylate DC | Magnesium Methylate AC Induction CKG) | $P_c$ (W/lb) | $P_z$ (VA/lb) | $\mu$ | Talc DC | Talc AC Induction (KG) | $P_c$ (W/lb) | z (VA/lb) | $\mu$ |
|---|---|---|---|---|---|---|---|---|---|---|
| | | 15 | 5.67 | 67.2 | 236 | | 15 | — | — | — |

*0.006 in × 0.020 in × 0.080 in low carbon steel (blackplate); decarburized.

TABLE V

Comparison of Magnetic Properties of Iron Particle*
Test Rings As Compacted

| Coating: Properties Compacting Pressure (psi) | Magnesium Methylate DC | Induction (kG) | $P_c$ (W/lb) | $P_z$ (VA/lb) | $AC_\mu$ | Talc DC | Induction (kG) | $P_c$ (W/lb) | $P_z$ (VA/lb) | $AC_\mu$ |
|---|---|---|---|---|---|---|---|---|---|---|
| 40,000 | | 2 | 0.39 | 0.87 | 451 | | 2 | 0.40 | 1.02 | 404 |
| | | 4 | 1.19 | 3.02 | 489 | | 4 | 1.23 | 3.58 | 440 |
| | | 6 | 21.30 | 7.60 | 418 | | 6 | 2.35 | 8.87 | 382 |
| | | 8 | 3.62 | 17.4 | 308 | | 8 | 3.70 | 19.7 | 292 |
| | | 10 | 5.11 | 42.5 | 189 | | 10 | 5.19 | 44.9 | 192 |
| | | 12 | 6.55 | 120 | 101 | | 12 | 6.74 | 116 | 109 |
| 80,000 | $B_{50}$ = 12,600G | 2 | 0.31 | 0.69 | 516 | $B_{50}$ = 12,550G | 2 | 0.31 | 0.72 | 485 |
| | | 4 | 0.96 | 2.15 | 633 | | 4 | 0.96 | 2.28 | 597 |
| | $B_{r50}$ = 4,450G | 6 | 1.86 | 4.75 | 618 | $B_{r50}$ = 3,950G | 6 | 1.83 | 5.07 | 577 |
| | | 8 | 2.96 | 9.30 | 539 | | 8 | 2.91 | 9.7 | 508 |
| | $H_{c50}$ = 3.61 Oe | 10 | 4.24 | 17.6 | 426 | $H_c$ = 3.61 Oe | 10 | 4.15 | 18.3 | 409 |
| | | 12 | 5.59 | 34.1 | 299 | | 12 | 5.52 | 34.9 | 294 |
| | | 14 | 7.04 | 75.0 | 180 | | 14 | 6.94 | 73.90 | 183 |
| | | 15 | 7.73 | 119 | 134 | | 15 | 7.63 | 115 | 137 |
| 120,00 | $B_{50}$ = 13,650G | 2 | 0.29 | 0.62 | 555 | $B_{50}$ = 13,600G | 2 | 0.28 | 0.66 | 520 |
| | | 4 | 0.89 | 1.91 | 697 | | 4 | 0.87 | 2.05 | 644 |
| | $B_{r50}$ = 4,850 G | 6 | 1.72 | 4.11 | 700 | $B_{r50}$ = 4,250G | 6 | 1.68 | 4.39 | 652 |
| | | 8 | 2.75 | 7.80 | 632 | | 8 | 2.66 | 8.20 | 591 |
| | $H_{c50}$ = 3.48 Oe | 10 | 3.94 | 14.0 | 521 | $H_{c50}$ = 3.52 Oe | 10 | 3.82 | 14.7 | 500 |
| | | 12 | 5.29 | 25.6 | 393 | | 12 | 5.13 | 26.3 | 386 |
| | | 14 | 6.73 | 50.5 | 260 | | 14 | 6.52 | 49.8 | 263 |
| | | 15 | 7.44 | 74.6 | 199 | | 15 | 7.24 | 72.2 | 205 |

*Machined chips from 0.013 in thick low carbon steel (blackplate); decarburized.

TABLE VI

Comparison of Magnetic Properties of Iron Particle*
Test Rings as Compacted

| Compacting Pressure (psi) | Coating: Magnesium Methylate DC | Magnesium Methylate AC Induction (kG) | $P_c$ (W/lb) | $P_z$ (VA/lb) | $\mu$ | Talc DC | Talc AC Induction (kG) | $P_c$ (W/lb) | $P_z$ (VA/lb) | $\mu$ |
|---|---|---|---|---|---|---|---|---|---|---|
| | | | | | | Properties | | | | |
| 40,000 | | 2 | 0.37 | 0.92 | 419 | | 2 | 0.36 | 0.91 | 422 |
| | | 4 | 1.15 | 3.22 | 457 | | 4 | 1.13 | 3.19 | 462 |
| | | 6 | 2.23 | 7.90 | 403 | | 6 | 2.19 | 7.70 | 415 |
| | | 8 | 3.55 | 17.2 | 314 | | 8 | 3.48 | 16.5 | 330 |
| | | 10 | 5.05 | 37.9 | 212 | | 10 | 4.99 | 35.1 | 229 |
| | | 12 | 6.70 | 93.2 | 123 | | 12 | 6.63 | 84.0 | 135 |
| 80,000 | $B_{50}$ = 12,400G | 2 | 0.32 | 0.73 | 490 | $B_{50}$ = 12,200G | 2 | 0.32 | 0.74 | 482 |
| | | 4 | 0.98 | 2.36 | 582 | | 4 | 0.99 | 2.45 | 560 |
| | $B_{r50}$ = 4,000G | 6 | 1.89 | 5.23 | 565 | $B_{r50}$ = 3,600G | 6 | 1.90 | 5.49 | 538 |
| | | 8 | 3.02 | 10.3 | 493 | | 8 | 3.03 | 10.8 | 469 |
| | $H_{c50}$ = 3.49 Oe | 10 | 4.35 | 19.4 | 390 | $H_{c50}$ = 3.50 Oe | 10 | 4.35 | 20.3 | 374 |
| | | 12 | 5.82 | 38.0 | 273 | | 12 | 5.80 | 39.2 | 266 |
| | | 14 | 7.40 | 83.6 | 164 | | 14 | 7.37 | 84.4 | 163 |
| 120,000 | $B_{50}$ = 13,700G | 2 | 0.29 | 0.63 | 550 | $B_{50}$ = 13,400G | 2 | 0.29 | 0.66 | 525 |
| | | 4 | 0.88 | 1.96 | 681 | | 4 | 0.91 | 2.12 | 630 |
| | $B_{r50}$ = 4,900G | 6 | 1.70 | 4.18 | 691 | $B_{r50}$ = 4,250G | 6 | 1.75 | 4.60 | 626 |
| | | 8 | 2.73 | 7.80 | 627 | | 8 | 2.80 | 8.70 | 567 |
| | $H_{c50}$ = 3.39 Oe | 10 | 3.95 | 14.0 | 524 | $H_{c50}$ = 3.50 Oe | 10 | 4.04 | 15.6 | 475 |
| | | 12 | 5.35 | 25.6 | 394 | | 12 | 5.42 | 28.2 | 362 |
| | | 14 | 6.88 | 50.8 | 256 | | 14 | 6.96 | 54.9 | 241 |

TABLE VI-continued

Comparison of Magnetic Properties of Iron Particle*
Test Rings as Compacted

| Compacting Pressure (psi) | Coating: Magnesium Methylate — Properties: DC | AC Induction (kG) | AC $P_c$ (W/lb) | AC $P_z$ (VA/lb) | AC $\mu$ | Talc — DC | AC Induction (kG) | AC $P_c$ (W/lb) | AC $P_z$ (VA/lb) | AC $\mu$ |
|---|---|---|---|---|---|---|---|---|---|---|
| | | 15 | 7.65 | 75.9 | 194 | | 15 | 7.75 | 80.8 | 184 |

*Machined chips from 0.060 in hot rolled low carbon steel (AISI 1020); decarburized; particles were about 1 mm long and 0.1–0.2 mm thick; curled; with rectangular cross-section; uniform size; thin edges; one side smooth - other side rough.

TABLE VII

Comparison of Magnetic Properties of Microlamination
Test Rings Annealed**

| Coating: Properties / Compacting Presure (psi) | Magnesium Methylate DC (at H=50 Oe) | AC Induction (kG) | $P_c$ (W/lb) | $\Delta P_c$ (W/lb) | $P_z$ (VA/lb) | $AC_{82}$ | Talc DC (at H=50 Oe) | AC Induction (kG) | $P_c$ (W/lb) | $\Delta P_c$ (W/lb) | $P_z$ (VA/lb) | $AC_\mu$ |
|---|---|---|---|---|---|---|---|---|---|---|---|---|
| 40,000 | B=10,420G | 2 | 0.31 | − 0.14 | 0.47 | 857 | B=9,300G | 2 | 0.17 | −0.12 | 0.72 | 550 |
| | | 4 | 1.19 | + 0.15 | 1.87 | 844 | | 4 | 0.56 | −0.31 | 2.89 | 520 |
| | $B_r$=1,700G | 6 | 2.81 | + 0.93 | 4.92 | 710 | $B_r$=600G | 6 | 1.18 | −0.50 | 8.12 | 390 |
| | | 8 | 5.22 | + 2.36 | 11.8 | 486 | | 8 | 2.02 | −0.62 | 21.2 | 253 |
| | $H_c$=0.8400e | 10 | 8.57 | + 4.67 | 30.0 | 268 | $H_c$= 0.7000e | 10 | 3.09 | −0.60 | 53.7 | 152 |
| | | 12 | 13.3 | + 8.39 | 83.9 | 134 | | 12 | 4.61 | −0.17 | 142 | 88 |
| | | 14 | 21.9 | +17.0 | 263 | 70 | | | | | | |
| 80,000 | B=13,145G | 2 | 0.33 | − 0.02 | 0.44 | 844 | B=12,100G | 2 | 0.17 | −0.09 | 0.47 | 8090 |
| | | 4 | 1.38 | + 0.50 | 1.81 | 792 | | 4 | 0.58 | −0.22 | 1.63 | 876 |
| | $B_r$=2,875G | 6 | 3.47 | + 1.83 | 4.63 | 693 | $B_r$=1,000G | 6 | 1.23 | −0.29 | 4.02 | 756 |
| | | 8 | 6.81 | + 4.24 | 9.55 | 597S | | 8 | 2.14 | −0.23 | 8.80 | 581 |
| | $H_c$=0.8480e | 10 | 11.5 | + 8.06 | 18.0 | 496 | $H_c$=0.7500e | 10 | 3.32 | −0.07 | 19.1 | 396 |
| | | 12 | 17.7 | +13.2 | 33.8 | 360 | | 12 | 4.82 | +0.40 | 42.1 | 248 |
| | | 14 | 25.6 | +20.0 | 71.3 | 204 | | 14 | 6.76 | +1.24 | 97.7 | 144 |
| | | 15 | 30.6 | +24.4 | 111 | 146 | | | | | | |
| 120,000 | B=14,450G | 2 | 0.36 | + 0.06 | 0.44 | 798 | B=13,700G | 2 | 0.21 | −0.05 | 0.37 | 987 |
| | | 4 | 1.53 | + 0.75 | 1.87 | 737 | | 4 | 0.76 | −0.02 | 1.34 | 1050 |
| | $B_r$=3,450G | 6 | 3.87 | + 2.42 | 4.767 | 645 | $B_r$=8,000G | 6 | 1.69 | +0.20 | 3.11 | 1004 |
| | | 8 | 7.67 | + 5.42 | 9.66 | 564 | | 8 | 3.05 | +0.73 | 6.38 | 841 |
| | $H_c$0.8500e | 10 | 13.1 | + 9.96 | 17.3 | 496 | $H_c$=0.770 Oe | 10 | 4.86 | +1.58 | 12.4 | 636 |
| | | 12 | 20.1 | +16.0 | 28.8 | 434 | | 12 | 7.08 | +2.74 | 23.8 | 442 |
| | | 14 | 28.9 | +23.7 | 50.2 | 326 | | 14 | 9.89 | +4.47 | 49.8 | 267 |
| | | 15 | 33.8 | +28.1 | 70.0 | 243 | | 15 | 11.6 | — | 76.9 | 194 |

*0.006 in × 0.020 in × 0.080 in slitted and chopped 0.006 in blackplate.
**Annealed for 1 hour at 850° C. in dry hydrogen and furnace cooled.

TABLE VIII

Comparison of Magnetic Properties of Iron Particle*
Test Rings Annealed**

| Coating: Properties / Compacting Pressure (psi) | Magnesium Methylate DC (at H=50 Oe) | AC Induction (kG) | $P_c$ (W/lb) | $\Delta P_c$ (W/lb) | $P_z$ (VA/lb) | $AC_\mu$ | Talc DC (at H=50 Oe) | AC Induction (kG) | $P_c$ (W/lb) | $\Delta P_c$ (W/lb) | $P_z$ (VA/lb) | $AC_\mu$ |
|---|---|---|---|---|---|---|---|---|---|---|---|---|
| 40,000 | B=10,310G | 2 | 0.42 | −0.03 | 0.53 | 787 | B=10,400G | 2 | 0.35 | −0.05 | 0.48 | 844 |
| | | 4 | 1.89 | +0.70 | 2.34 | 673 | | 4 | 1.36 | +0.13 | 1.89 | 838 |
| | $B_r$=4,025G | 6 | 5.15 | +2.85 | 6.69 | 525 | $B_r$=2,400G | 6 | 3.23 | +0.88 | 4.92 | 728 |
| | | 8 | 10.5 | +6.88 | 15.4 | 415 | | 8 | 6.02 | +2.32 | 11.7 | 507 |
| | $H_c$=0.940Oe | 10 | 17.4 | +12.3 | 37.2 | 241 | $H_c$=0.960Oe | 10 | 9.88 | +4.69 | 30.6 | 259 |
| | | 12 | 27.7 | +21.2 | 112 | 106 | | 12 | 15.4 | +8.66 | 93.4 | 121 |
| 80,000 | B=13,100G | 2 | 0.39 | −0.08 | 0.47 | 787 | B=13,400G | 2 | 0.33 | +0.02 | 0.44 | 844 |
| | | 4 | 1.76 | +0.80 | 2.10 | 678 | | 4 | 1.348 | +0.42 | 1.76 | 815 |
| | $B_r$=5,300G | 6 | 4.80 | +2.94 | 5.85 | 538 | $B_r$=3,650G | 6 | 3.40 | +1.57 | 4.40 | 719 |
| | | 8 | 10.2 | +7.24 | 12.8 | 434 | | 8 | 67.59 | +3.68 | 8.95 | 634 |
| | $H_c$=0.985Oe | 10 | 17.9 | +13.7 | 23.8 | 367 | $H_c$=0.980Oe | 10 | 11.0 | +6.85 | 16.6 | 547 |
| | | 12 | 27.1 | +21.8 | 41.6 | 315 | | 12 | 16.5 | +11.0 | 31.2 | 386 |
| | | 14 | 38.7 | +31.7 | 82.9 | 188 | | 14 | 23.3 | +16.4 | 68.7 | 203 |
| | | 15 | 45.7 | +38.0 | 128 | 132 | | 15 | 27.9 | +20.3 | 110 | 143 |
| 120,000 | B=14,600G | 2 | 0.39 | +0.10 | 0.46 | 777 | B=14,300G | 2 | 0.31 | +0.03 | 0.40 | 896 |
| | | 4 | 1.74 | +0.85 | 2.06 | 662 | | 4 | 1.27 | +0.40 | 1.59 | 876 |
| | $B_r$=6,100G | 6 | 4.73 | +3.01 | 5.64 | 538 | $B_r$=4,000G | 6 | 3.12 | +1.44 | 3.92 | 784 |
| | | 8 | 9.89 | +7.14 | 12.0 | 447 | | 8 | 6.04 | +3.38 | 7.80 | 697 |
| | $H_c$=0.980Oe | 10 | 17.4 | +13.5 | 21.9 | 383 | $H_c$=1.07 Oe | 10 | 10.0 | +6.18 | 13.8 | 625 |
| | | 12 | 27.0 | +21.7 | 35.9 | 339 | | 12 | 15.1 | +9.97 | 23.9 | 536 |

TABLE VIII-continued

Comparison of Magnetic Properties of Iron Particle*
Test Rings Annealed**

| Coating: | Magnesium Methylate | | | | | | Talc | | | | | |
|---|---|---|---|---|---|---|---|---|---|---|---|---|
| Properties | | AC | | | | | | AC | | | | |
| Compacting Pressure (psi) | DC (at H=50 Oe) | Induction (kG) | $P_c$ (W/lb) | $\Delta P_c$ (W/lb) | $P_z$ (VA/lb) | $AC_\mu$ | DC (at H=50 Oe) | Induction (kG) | $P_c$ (W/lb) | $\Delta P_c$ (W/lb) | $P_z$ (VA/lb) | $AC_\mu$ |
| | | 14 | 37.7 | +31.0 | 58.3 | 300 | | 14 | 21.2 | +14.7 | 45.3 | 323 |
| | | 15 | 43.6 | +36.2 | 768.2 | 237 | | 15 | 24.7 | +17.5 | 67.3 | 229 |

*Machined chips from 0.013 in thick low carbon steel (blackplate): decarburizedc.
**Annealed 1 hour at 850° C. in dry hydrogen and furnace cooled.

TABLE IX

Comparison of Magnetic Properties of Iron Particle*
Test Rings Annealed**

| Coating: | Magnesium Methylate | | | | | | Talc | | | | | |
|---|---|---|---|---|---|---|---|---|---|---|---|---|
| Properties | | AC | | | | | | AC | | | | |
| Compacting Pressure (psi) | DC (at H=50 Oe) | Induction (kG) | $P_c$ (W/lb) | $\Delta P_c$ (W/lb) | $P_z$ (VA/lb) | $AC_2$ | DC (at H=50 Oe) | Induction (kG) | $P_c$ (W/lb) | $\Delta P_c$ (W/lb) | $P_z$ (VA/lb) | $AC_\mu$ |
| 40,000 | B=12,150G | 2 | 0.44 | +0.07 | 0.71 | 571 | B=10,525G | 2 | 0.54 | +0.18 | 0.79 | 515 |
| | | 4 | 1.74 | +0.59 | 2.90 | 547 | | 4 | 2.18 | +1.05 | 3.24 | 484 |
| | $B_r$=1,650G | 6 | 4.09 | +1.86 | 7.54 | 467 | $B_r$=1,350G | 6 | 5.33 | +3.14 | 8.36 | 421 |
| | | 8 | 7.70 | +4.15 | 17.2 | 354S | | 8 | 10.3 | +6.82 | 18.0 | 349 |
| | $H_c$=0.910Oe | 10 | 12.7 | +7.65 | 39.9 | 214 | $H_c$=1.01 Oe | 10 | 17.2 | +12.2 | 38.0 | 244 |
| | | 12 | 19.9 | +13.2 | 105 | 112 | | 12 | 26.8 | +20.2 | 91.4 | 130 |
| 80,000 | B=13,200G | 2 | 0.42 | +0.10 | 0.54 | 685 | B=13,200G | 2 | 0.45 | +0.13 | 0.53 | 702 |
| | | 4 | 1.75 | +0.77 | 2.24 | 640 | | 4 | 1.65 | +0.66 | 2.13 | 681 |
| | $B_r$=3,000G | 6 | 4.48 | +2.59 | 5.75 | 551 | $B_r$=2,400G | 6 | 4.09 | +2.19 | 5.32 | 604 |
| | | 8 | 9.17 | +6.15 | 12.0 | 466 | | 8 | 8.13 | +5.10 | 10.8 | 523 |
| | $H_c$=0.950 | 10 | 16. | +11.8 | 22.2 | 397 | $H_c$=0.95 Oe | 10 | 14.0 | +9.65 | 19.7 | 452 |
| | | 12 | 24.9 | +19.1 | 39.5 | 334 | | 12 | 21.6 | +15.8 | 35.3 | 368 |
| | | 14 | 35.9 | +28.5 | 80.1 | 192 | | 14 | 31.0 | +23.6 | 72.8 | 205 |
| 120,000 | B=14,400G | 2 | 0.40 | +0.11 | 0.50 | 702 | B=14,200G | 2 | 0.39 | +0.10 | 0.50 | 710 |
| | | 4 | 1.68 | +0.80 | 2.09 | 658 | | 4 | 1.58 | +0.67 | 2.00 | 702 |
| | $B_r$=3,500G | 6 | 4.31 | +2.61 | 5.39 | 5654 | $B_r$=2,7600G | 6 | 3.89 | +2.14 | 4.94 | 631 |
| | | 8 | 8.92 | +6.19 | 11.3 | 477 | | 8 | 7.71 | +4.91 | 9.90 | 553 |
| | $H_c$=0.980Oe | 10 | 16.0 | +12.0 | 210.8 | 403 | $H_c$=0.940Oe | 10 | 13.4 | +9.36 | 17.9 | 480 |
| | | 12 | 25.5 | +20.2 | 35.2 | 346 | | 12 | 20.9 | +15.5 | 30.5 | 409 |
| | | 14 | 36.8 | +29.9 | 58.9 | 289 | | 14 | 30.0 | +23.0 | 55.2 | 293 |
| | | 15 | 43.0 | +35.4 | 80.4 | 229 | | 15 | 35.3 | +27.8 | 80.1 | 208 |

*Machined chips from 0.060 in hot rolled low carbon steel (AISI 1020); decarburized, particles were about 1 mm long and 1-2 mm thick, curled, with rectangular cross-section; uniform size; thin edges; one side smooth - other side rough.
**Annealed 1 hour at 850° C. in dry hydrogen and furnace cooled.

What is claimed is:

1. A method of making pressed magnetic core components for use in electrical apparatus, comprising the steps of:

(a) severing microlaminations from thin, flat strips of ferromagnetic alloys having an elongated rectangular cross-section and up to about 0.20 inch in length, (b) annealing the microlaminations in decarburizing atmosphere at a temperature range of from about 1000° F. to about 1650° F. for about 30 minutes in moist hydrogen having a dew point of about +120° F. to improve the magnetic characteristics by reducing carbon content to less than 0.010%, (c) coating the microlaminations with a layer of hydrated magnesium silicate whereby to provide a chemically stable non-volatile, non-flammable, non-toxic compact having low die and punch friction packing factors, (d) compressing microlaminations into a solidified compact, and (e) annealing the solidified compact at a temperature of from about 537° C. to about 900° C. to obtain high permeability and low coercive force values.

2. The method of claim 1 in which annealing at step (b) occurs in the temperature range of from about 537° C. to about 900° C.

3. The method of claim 2 in which at step (b) the annealing temperature is about 800° C.

4. The method of claim 3 in which the hydrated magnesium silicate is applied to the microlaminations by blending hydrated magnesium silicate at about 0.5% of the weight of the microlaminations.

* * * * *